US012162567B2

(12) United States Patent
Lewison et al.

(10) Patent No.: US 12,162,567 B2
(45) Date of Patent: Dec. 10, 2024

(54) RECONFIGURABLE WAKESURF BINDING APPARATUS AND SYSTEM

(71) Applicant: Kwik Tek, Inc., Denver, CO (US)

(72) Inventors: Corey A. Lewison, Superior, CO (US); Kevin J. Kresch, Arvada, CO (US)

(73) Assignee: Kwik Tek, Inc., Denver, CO (US)

( * ) Notice: Subject to any disclaimer, the term of this patent is extended or adjusted under 35 U.S.C. 154(b) by 423 days.

(21) Appl. No.: 17/648,319

(22) Filed: Jan. 19, 2022

(65) Prior Publication Data

US 2022/0234694 A1 Jul. 28, 2022

Related U.S. Application Data

(60) Provisional application No. 63/142,628, filed on Jan. 28, 2021.

(51) Int. Cl.
*B63B 32/40* (2020.01)
*B63B 32/50* (2020.01)

(52) U.S. Cl.
CPC ..... *B63B 32/47* (2020.02); *B63B 32/50* (2020.02)

(58) Field of Classification Search
CPC ..... B63B 32/47; B63B 32/50
USPC ..... 440/70
See application file for complete search history.

(56) References Cited

U.S. PATENT DOCUMENTS 3,134,992 A * 6/1964 Tyll ..... B63B 32/50 280/609
4,466,373 A * 8/1984 Prade ..... B63B 32/45 280/622
6,237,520 B1 * 5/2001 Sisseren ..... B63B 32/45 114/39.19
2013/0277956 A1 * 10/2013 Walburn ..... A63C 5/16 280/818

* cited by examiner

*Primary Examiner* — Stephen P Avila
(74) *Attorney, Agent, or Firm* — Talus Law Group LLC

(57) ABSTRACT

A reconfigurable wakesurf binding apparatus and system is provided. In certain embodiments, the wakesurf binding may comprise a top surface of a wakesurf board having a longitudinal axis, a first pair of female threaded inserts in the top surface aligned along a first axis angularly offset from the longitudinal axis of the wakesurf board by a first offset angle, a first strap having a first end comprising a first matrix of holes therethrough, a second end comprising a second matrix of holes therethrough, and a longitudinal axis, wherein the first strap is configured to be removably interconnected with the first pair of female threaded inserts with its longitudinal axis at an angle offset from the first axis, a second pair of female threaded inserts in the top surface aligned along the longitudinal axis of the wakesurf board.

20 Claims, 8 Drawing Sheets

RECONFIGURABLE WAKESURF BINDING APPARATUS AND SYSTEM

This application claims benefit to provisional patent application No. 63/142,628, entitled "RECONFIGURABLE WAKESURF BINDING APPARATUS AND SYSTEM", filed Jan. 28, 2021, which is incorporated by reference in its entirety for all purposes.

FIELD OF THE INVENTION

The present invention surrounds a reconfigurable wakesurf binding as shown in and described herein.

BACKGROUND OF THE INVENTION

Wakesurfing involves riding a wakesurf board in the wake of a boat without a rope or tether, such as used in water skiing. Wakesurfing can be performed on a board with or without bindings dependent upon the preference of the rider. However, current wakesurf bindings offer limited or no adjustability or require numerous penetrations into the top surface of the board which can compromise the structure of the board and/or lead to water penetration into the interior of core of the board.

SUMMARY OF THE INVENTION

The wakesurf binding disclosed herein provides a number of advantages depending on the particular aspect, embodiment, and/or configuration. It provides the advantages of minimizing board penetrations while allowing a user to removably interconnect and reconfigure a binding based on factors such as a user's foot size, preferred binding tension, riding style left-foot forward (regular) or right-foot forward (goofy) stance, and angle relative to the longitudinal axis of the board and/or relative to each foot.

DETAILED DESCRIPTION OF VARIOUS EMBODIMENTS

Figure 1A:
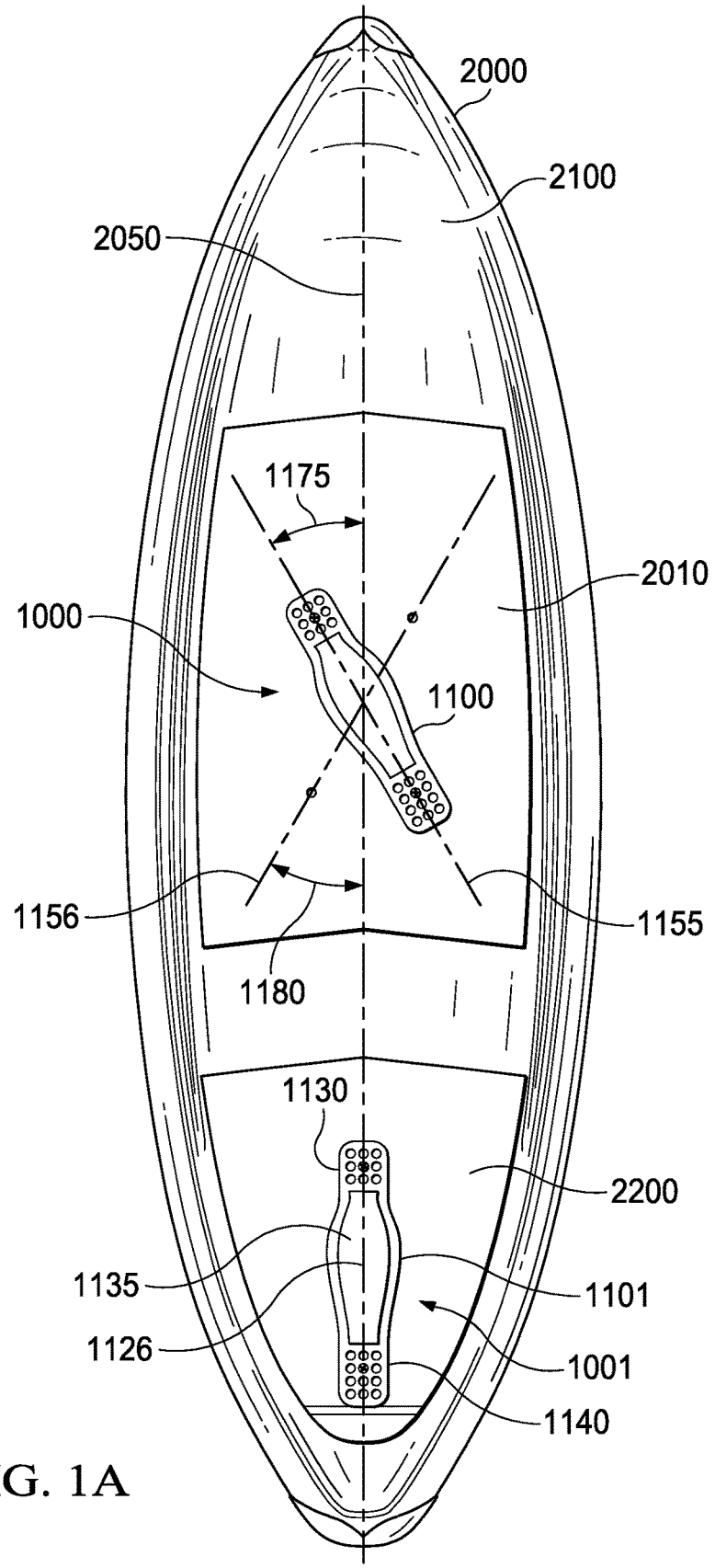
FIG. 1A—Is a plan view of a wakesurf board showing an embodiment of the wakesurf binding system.

As shown in FIG. 1A, the wakesurf binding apparatus and system comprises a first wakesurf binding 1000. A first strap

1100 for constraining the forward foot of a user is configured to be interconnected with a top surface 2010 at a forward portion 2100 of a wakesurf board 2000. In certain embodiments, the wakesurf binding apparatus and system comprises a second wakesurf binding 1001. A second strap 1101 for constraining the rearward foot of a user is configured to be interconnected with a top surface 2010 at a rearward portion 2200 of wakesurf board 2000.

Figure 2:
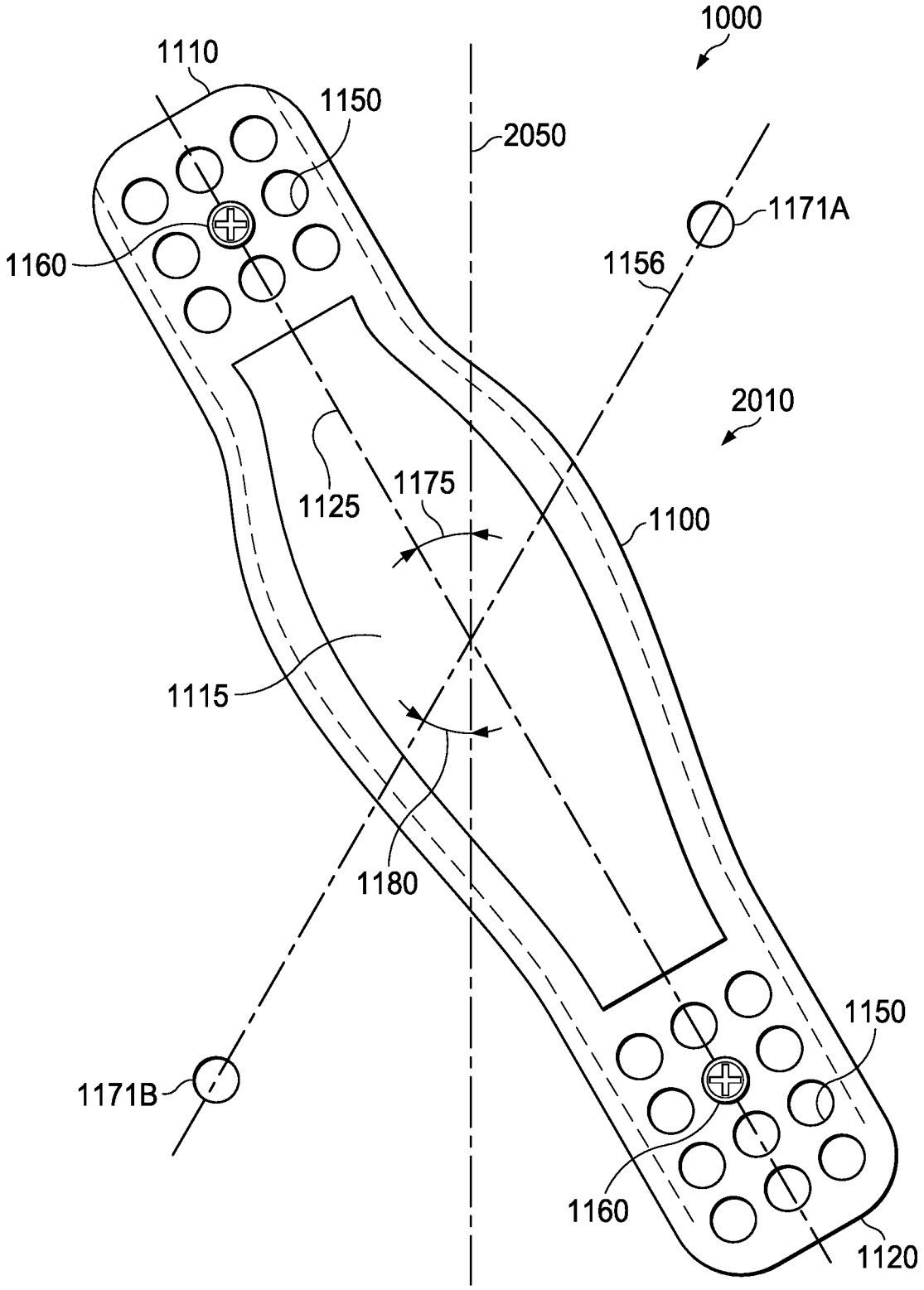
FIG. 2—Is a plan view of an embodiment of a strap of the wakesurf binding system in a first position.
Figure 3:
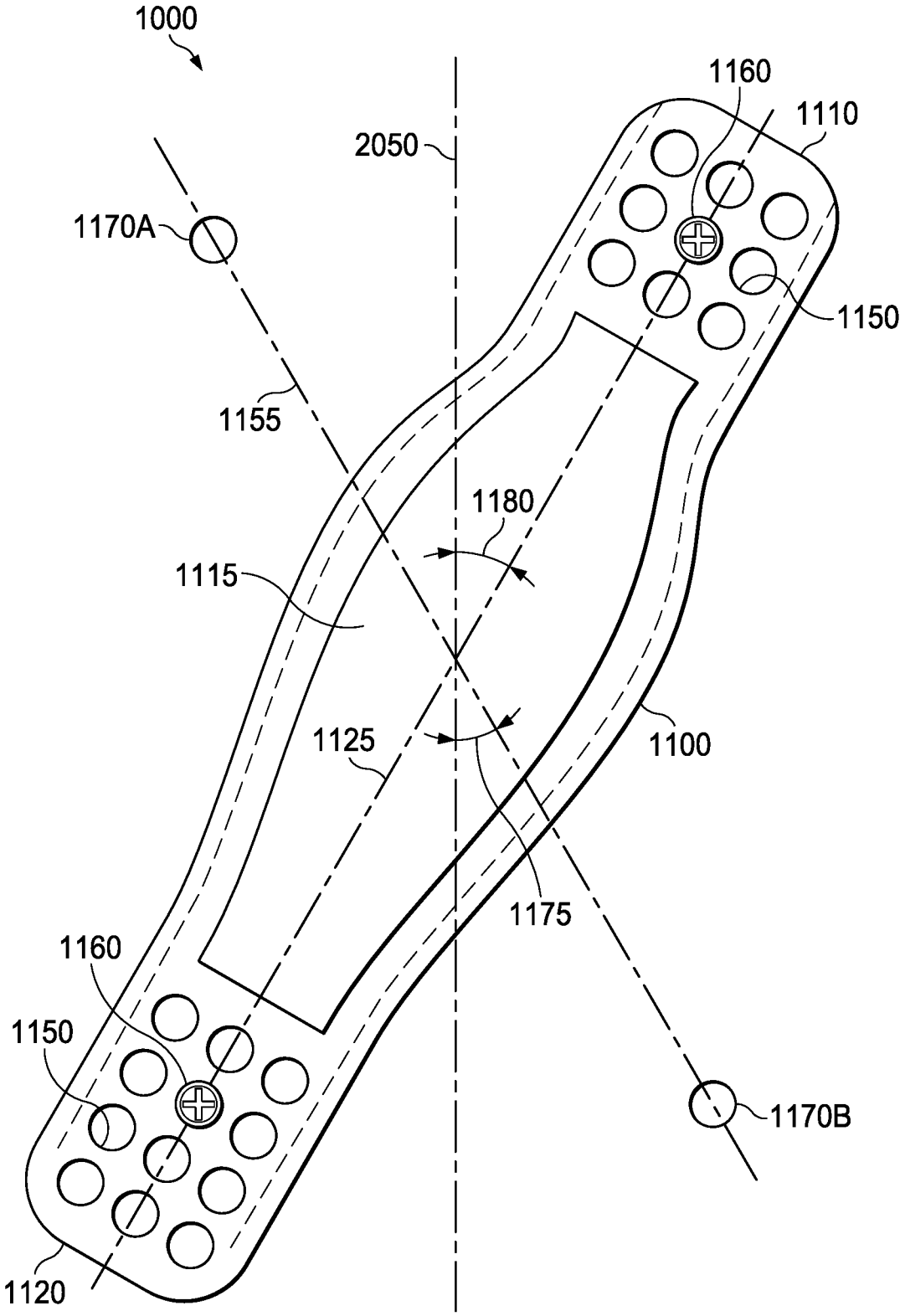
FIG. 3—Is a plan view of an embodiment of a strap the wakesurf binding system in a second position.
Figure 4:
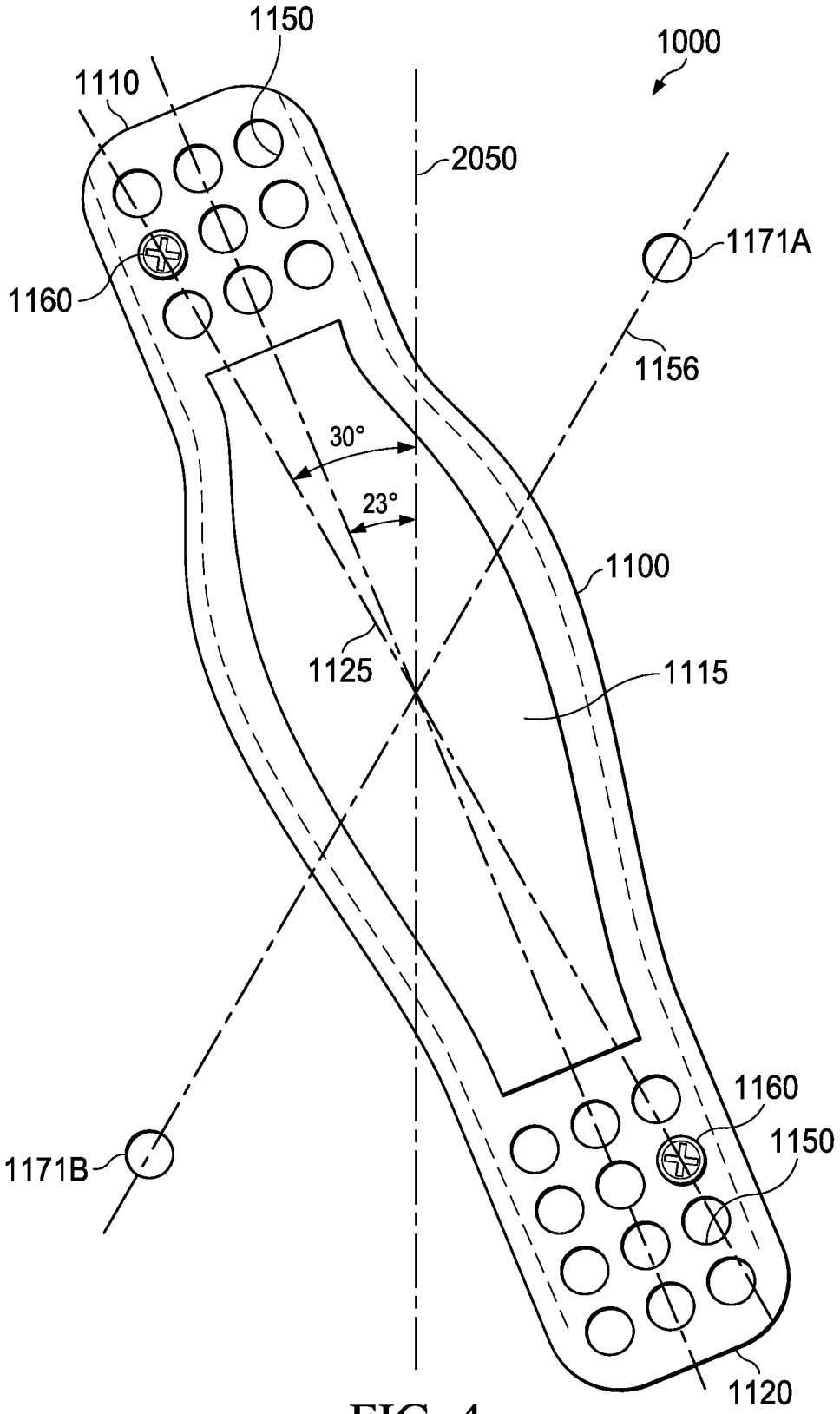
FIG. 4—Is a plan view of an embodiment of a strap the wakesurf binding system in a third position.

As shown in FIGS. 2-4, in certain embodiments, the first strap 1100 of the wakesurf binding 1000 comprises a first end 1110, a mid-section 1115, a second end 1120, and a longitudinal axis 1125. The first end 1110 of the strap comprises a plurality of holes 1150 arranged in a matrix. Each hole is adapted for inserting a screw 1160 therethrough. Screw 1160 is inserted through one of the holes 1150 of the matrix of the first end 1110 and threaded into a first female threaded insert 1170A of the board, thereby interconnecting the first end 1110 of strap 1100 with the board 2000. Similarly, in certain embodiments, the second end 1120 of the strap comprises a plurality of holes 1150 arranged in a matrix and adapted for inserting a screw 1160 therethrough. Screw 1160 is inserted through one of the holes 1150 of the matrix of the second end 1120 and threaded into a second female threaded insert 1170B of the board, thereby interconnecting the second end 1120 of strap 1100 with the board 2000.

Figure 1B:
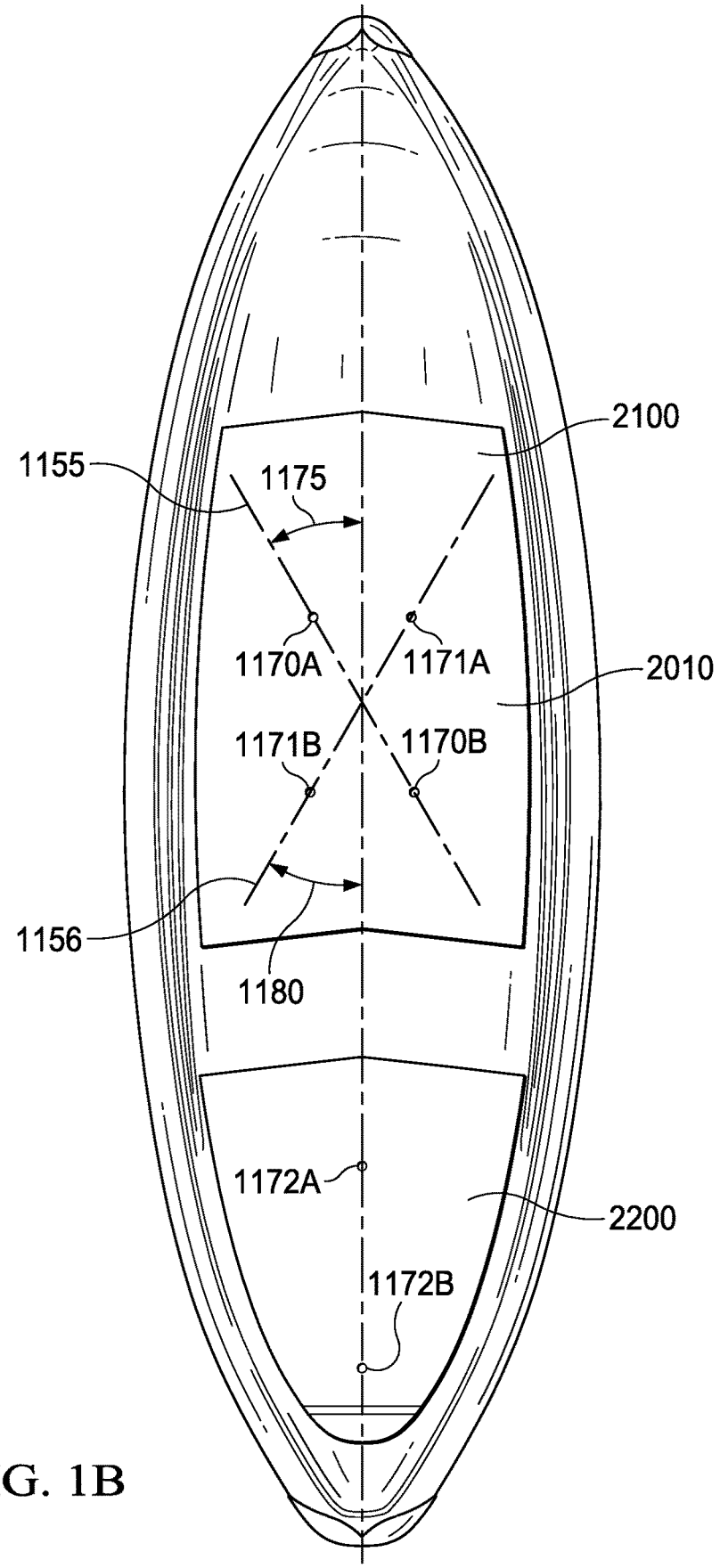
FIG. 1B—Is a plan view of a wakesurf board showing an embodiment of the threaded insert of the wakesurf binding system.
Figure 5:
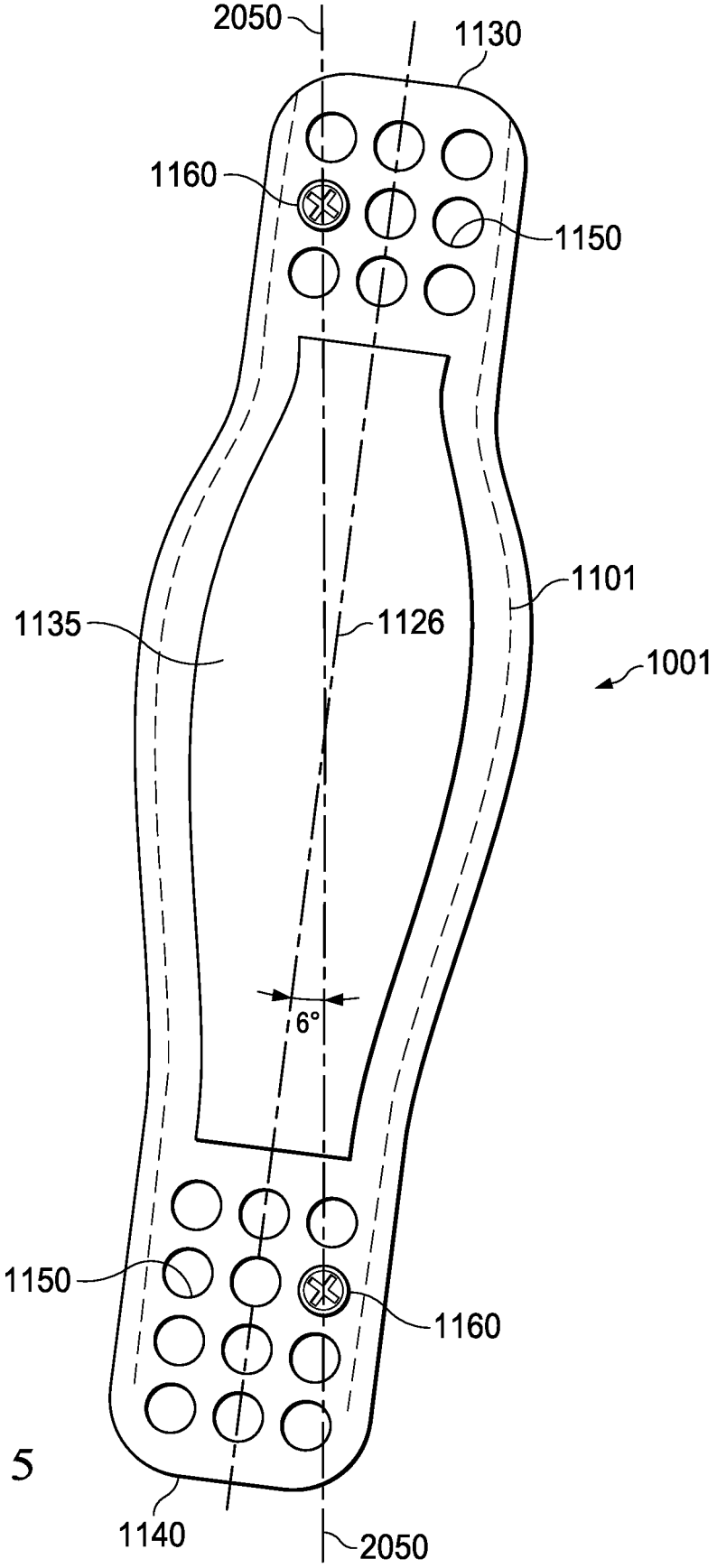
FIG. 5—Is a plan view of an embodiment of a strap the wakesurf binding system in a fourth position.

As shown in FIG. 1B, in certain embodiments, a third pair of female threaded inserts 1172A and 1172B are arranged along the longitudinal axis 2050 in rear portion 2200 of board 2000. As shown in FIGS. 1A and 5, second strap 1101 comprises a longitudinal axis 1126, a first end 1130, mid-section 1135, and a second end 1140. The first end 1130 of the second strap 1101 comprises a plurality of holes 1150 arranged in a matrix. Each hole is adapted for inserting a screw 1160 therethrough. Screw 1160 is inserted through one of the holes 1150 of the matrix of the first end 1130 and threaded into female threaded insert 1172A of the board, thereby interconnecting the first end 1130 of strap 1101 with the board 2000. Similarly, in certain embodiments, the second end 1140 of the second strap 1101 comprises a plurality of holes 1150 arranged in a matrix and adapted for inserting a screw 1160 therethrough. Screw 1160 is inserted through one of the holes 1150 of the matrix of the second end 1140 and threaded into female threaded insert 1172B of the board, thereby interconnecting the second end 1140 of second strap 1101 with the board 2000.

Figure 7A:
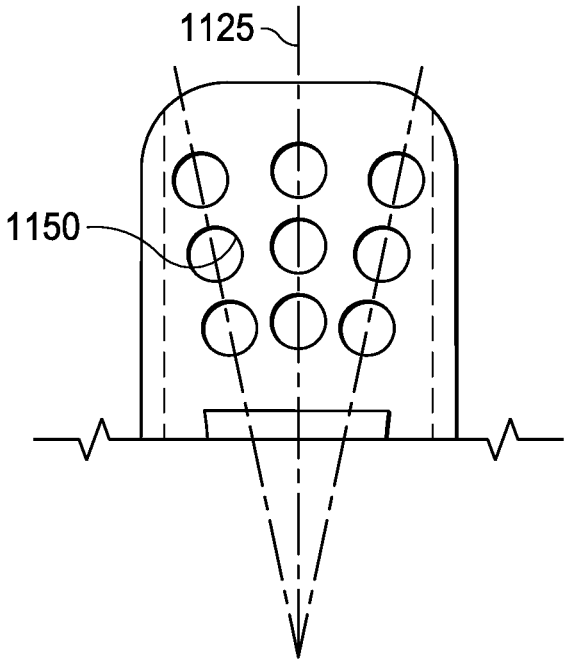
FIG. 7A—Is a plan view of a strap end in an embodiment of the wakesurf binding system.
Figure 7B:
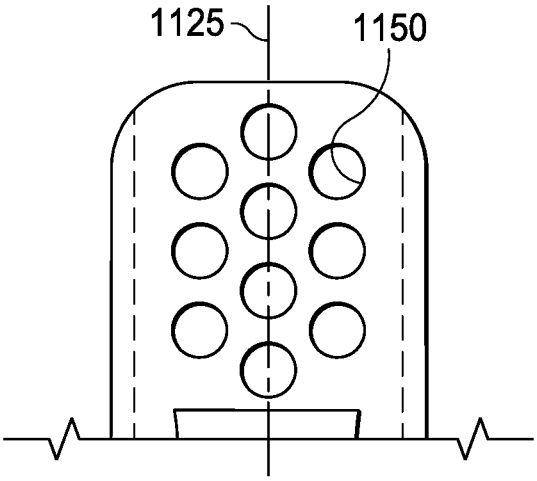
FIG. 7B—Is a plan view of a strap end in an embodiment of the wakesurf binding system.
Figure 7C:
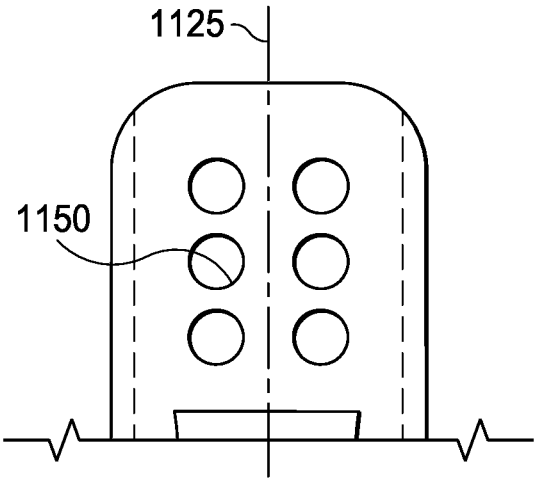
FIG. 7C—Is a plan view of a strap end in an embodiment of the wakesurf binding system.

As seen in FIGS. 1A, 2-5, and 7A-7C, the plurality of holes 1150 in strap first ends 1110 and 1130 and/or strap second ends 1120 and 1140 are arranged in a matrix pattern. In certain embodiments, the matrix pattern may comprise a 3 by 3 pattern of holes 1150 as shown as shown in the first end 1110 in FIG. 2, while other embodiments comprise a 3 by 4 pattern of holes 1150 as shown in the second end 1120 in FIG. 2. In a preferred embodiment, the matrix comprises a 3 by pattern such that the center row of holes 1150 is substantially aligned with the longitudinal axis 1125 of the strap, with a second and third row of holes 1150 to either side. However, alternative numbers of holes 1150 can be used while in keeping with the spirit and scope of the present invention, such as 2 by 2, 2 by 3, 4 by 4, 4 by 5, 5 by 5, etc. The matrix of holes 1150 may be plurality of rows of holes aligned in a grid pattern as shown in FIG. 2, aligned in a radial pattern with the center of the radius originating along the longitudinal axis 1125 of the strap 1100 as shown in FIG. 7A, aligned in a staggered pattern with the rows of holes offset relative to one another as shown in FIG. 7B, or aligned in a 2 by pattern on either side of the longitudinal axis 1125 as shown in FIG. 7C. In certain embodiments, first end 1110 and/or second end 1120 comprise a stiffener plate made of metal, such as of aluminum, or of plastic, with holes aligning with the hole pattern of first end 1110 and/or second end 1120. In some embodiments, the stiffener plate is embedded within the first end 1110 and/or second end 1120. In other embodiments, the stiffener plate is placed on the top surface of the strap 1100 to act like a fender washer. In certain embodiments, the first end 1110 and/or second end 1120 are comprised of a relatively inflexible material such as molded plastic or nylon, and the mid-section 1125 is comprised of a relatively flexible material such as woven nylon, vinyl, foam, and/or neoprene. Second strap 1101 may be similarly constructed to first strap 1100.

In certain embodiments, wakesurf board 2000 comprises a longitudinal axis 2050, a forward portion 2100, and a rear portion 2200. A forward portion 2100 of the board comprises a first pair of female threaded inserts 1170A and 1170B and a second pair of female threaded inserts 1171A and 1171B. The first pair of female threaded inserts 1170A and 1170B comprise a first female threaded insert and a second female threaded insert spaced a distance apart that is less than the length of the first strap 1100, wherein the first pair of female threaded inserts 1170A and 1170B are coincident with first axis 1155 offset from longitudinal axis 2050 of the board at a first offset angle 1175. The second pair of female threaded inserts 1171A and 1171B comprise a first female threaded insert and a second female threaded insert spaced a distance apart that is less than the length of the first strap 1100, wherein the second pair of female threaded inserts 1171A and 1171B are coincident with second axis 1156 offset from the longitudinal axis 2050 of the board at a second offset angle 1180.

In a preferred embodiment, the first angle 1175 and the second angle 1180 are about equal and in opposite directions relative to the longitudinal axis 2050 of the board. In certain embodiments, the first angle 1175 and the second angle 1180 are unequal. The angle of offset of the first angle 1175 of certain embodiments is about 30 degrees, and the second angle 1180 of certain embodiments is about −30 degrees. In such embodiments, the first pair of female threaded inserts are configured for use in riding left foot forward, and the second pair of female threaded inserts are configured for use in riding right foot forward. Alternative offset angle ranges can be used while in keeping with the spirit and scope of the present invention, such as 1 and −1 degrees to 5 and −5 degrees, 5 and −5 degrees to 10 and −10 degrees, 10 and −10 degrees to 15 and −15 degrees, 15 and −15 degrees to 20 and −20 degrees, 20 and −20 degrees to 25 and −25 degrees, 25 and −25 degrees to 30 and −30 degrees, 30 and −30 degrees to 35 and −35 degrees. As shown in FIGS. 2-3, the opposing pairs of female threaded inserts allow a user to switch first strap 1100 to a preferred angled position for riding the wakesurf board with either the left foot forward or right foot forward, respectively.

Figure 6A:
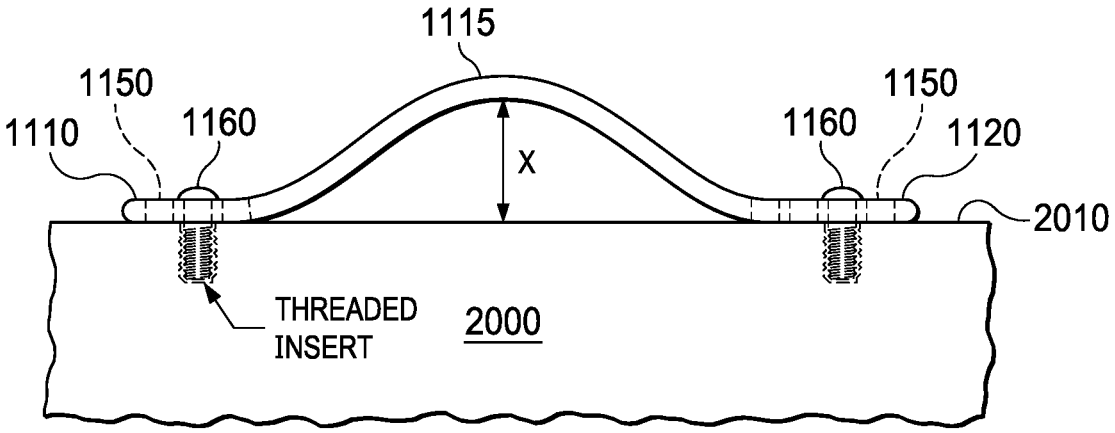
FIG. 6A—Is a side view of an embodiment of a strap of the wakesurf binding system in a fourth position.
Figure 6B:
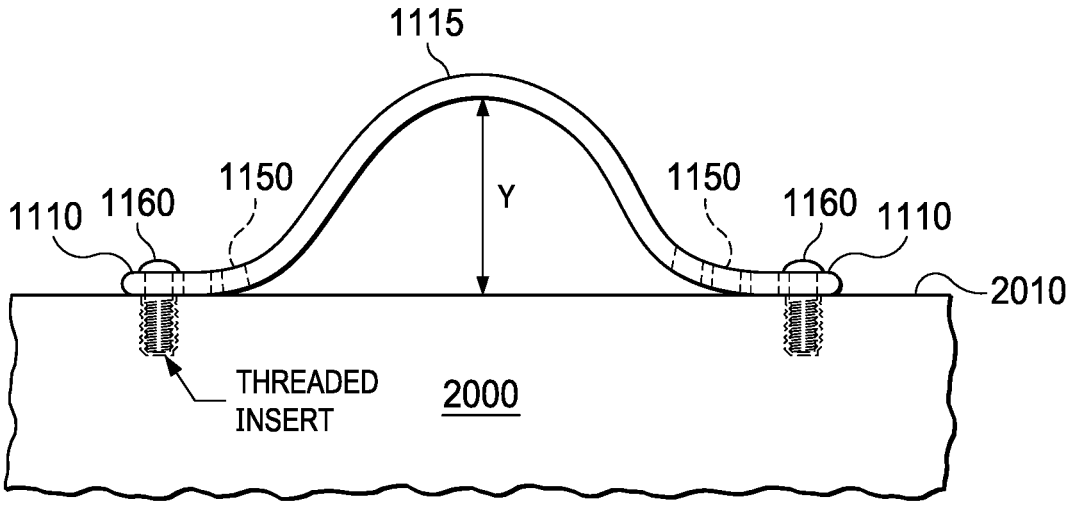
FIG. 6B—Is a side view of an embodiment of a strap of the wakesurf binding system in a fifth position.

The matrix pattern of the holes 1150 allows a user to configure the mounting of the first strap 1000 according to foot size and/or preferred binding tension. For example, as shown in FIG. 6A, to make the strap shorter or tighter relative to a user's foot size (X), screws 1160 are inserted through one of the holes 1150 of the matrix in first end 1110 and/or second end 1120 closer to the mid-section 1115 in order to interconnect the strap to the board 2000. Conversely, as shown in FIG. 6B, to make the strap longer or looser relative to a user's foot size (Y), screws 1160 are inserted through one of the holes 1150 of the matrix in first end 1110 and/or second end 1120 further from the mid-section 1115 in order to interconnect the strap to the board 2000.

As shown in FIG. 4, the matrix pattern of the holes 1150 in the first end 1110 and second 1120 allows a user to make angular adjustments to the first strap 1100 from the fixed angles permitted by female thread inserts 1170A and 1170B and first axis 1155, and 1171A and 1171B and second axis 1156. For example, as shown, by inserting screws 1160 through strap holes 1150 that are on opposing sides of longitudinal axis 1125 of strap 1100, the offset angle between the longitudinal axis of the strap 1125 and the longitudinal axis 2050 of the wakesurf board is reduced from the fixed offset angle 1175 of 30 degrees to about 23 degrees. As will be appreciated, by inserting screws 1160 through strap holes 1150 on opposing sides of longitudinal axis 1125 of strap 1100 in the reverse position from that shown in FIG. 4 would increase the angle between longitudinal axis 1125 and longitudinal axis 2050 from the fixed first angle 1175 of about 30 degrees to about 36 degrees. As will also be appreciated, by inserting screws 1160 through strap holes 1150 that are on the same side of longitudinal axis 1125 of strap 1100, the position of the strap 1100 may be shifted laterally without altering the angle between the longitudinal axis 1125 and the longitudinal axis 2050. As will also be appreciated, by inserting a screw 1160 through a strap hole 1150 that is offset from the longitudinal axis 1125 on one end of strap 1100 and by inserting a screw 1160 through a strap hole 1150 that is on the longitudinal axis 1125 on the other end of strap 1100, the angle between the longitudinal axis 1125 and the first axis 1155 or second axis 1156 would be greater than 0 degrees.

As shown in FIG. 1A, in certain embodiments, a second strap 1101 interconnected with a rear portion 2200 of the board, has a single mounting position. In alternate embodiments, the second strap comprises a plurality of holes 1150 for use in interconnecting the strap with female threaded inserts 1160 of the board. In alternate embodiments, the strap mounting position at the rear portion of the board comprises a first and second pair of female threaded inserts arranged the same or similarly to the forward portion as described herein and shown in FIGS. 2-4.

Depending upon how the holes are arranged and spaced in the matrix, the angle of variable offset of the first and second straps may be adjusted by 1 and −1 degrees to 3 and −3 degrees, 3 and −3 degrees to 6 and −6 degrees, 6 and −6 degrees to 9 and −9 degrees, 9 and −9 degrees to 12 and −12 degrees, 12 and −12 degrees to 15 and −15 degrees, 15 and −15 degrees to 18 and −18 degrees, 18 and −18 degrees to 21 and −21 degrees.

As shown in FIG. 5, the matrix pattern of the holes 1150 in the first end 1130 and second 1140 allows a user to make angular adjustments to the second strap 1101 from the longitudinal position permitted by female thread inserts 1172A and 1172B that are arranged along the longitudinal axis 2050 of the board. For example, as shown, by inserting screws 1160 through strap holes 1150 that are on opposing sides of longitudinal axis 1126 of strap 1101, the angle between the longitudinal axis 1126 and the longitudinal axis 2050 of the wakesurf board is set to about 6 degrees. As will be appreciated, by inserting screws 1160 through strap holes 1150 on opposing sides of longitudinal axis 1126 of strap 1101 in the reverse position from that shown in FIG. 5 would reverse the angle between longitudinal axis 1126 and longitudinal axis 2050 to about −6 degrees. As will also be appreciated, by inserting a screw 1160 through a strap hole 1150 that is offset from the longitudinal axis 1126 on one end of strap 1101 and by inserting a screw 1160 through a strap hole 1150 that is on the longitudinal axis 1126 on the other end of strap 1101, the angle between the longitudinal axis 1126 and the longitudinal axis 2050 of the wakesurf board would be greater than 0 degrees. As will also be appreciated, by inserting screws 1160 through strap holes 1150 that are on the same side of longitudinal axis 1126 of strap 1101, the position of the strap may be shifted laterally without altering the angle between the longitudinal axis 1126 and the longitudinal axis 2050.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. Other aspects, embodiments, and/or configurations of the disclosure are possible utilizing, alone or in combination, one or more of the inserts set forth above or described in detail below. Also, while the disclosure is presented in terms of exemplary embodiments, it should be appreciated that individual aspects of the disclosure can be separately claimed.

The structural materials employed advantageously in the present invention are fashioned from: molded, injected, extruded or machined plastics; molded, injected, extruded or machined rubber; extruded, machined, or cast aluminum, stainless steel, or other metals; and suitable alternatives are available, as one skilled in the art would recognize readily. Likewise, any padding, where padding is desirable, is preferably some kind of foamed elastomer, though other suitable materials exist. Other hardware, brackets, locking pins and supports may be fashioned from aluminum, stainless steel, brass, or other suitable material. One of ordinary skill in the art will appreciate that embodiments of the present disclosure may be constructed of materials known to provide, or predictably manufactured to provide the various aspects of the present disclosure. These materials may include, for example, stainless steel, titanium alloy, aluminum alloy, chromium alloy, and other metals or metal alloys. These materials may also include, for example, carbon fiber, ABS plastic, polyurethane, and other fiber-encased resinous materials, synthetic materials, polymers, and natural materials. The system and its elements could be flexible, semi-rigid, or rigid and made of materials such as stainless steel, titanium alloy, aluminum alloy, chromium alloy, and other metals or metal alloys, carbon fiber, ABS plastic, polyurethane, and other fiber-encased resinous materials, synthetic materials, polymers, and natural materials. In one embodiment, some or all components are manufactured by way of 3-D printing.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Description for example, various inserts of the disclosure are grouped together in one or more aspects, embodiments, and/or configurations for the purpose of streamlining the disclosure. The inserts of the aspects, embodiments, and/or configurations of the disclosure may be combined in alternate aspects, embodiments, and/or configurations other than those discussed above. This method of disclosure is not to be interpreted as reflecting an intention that the claims require more inserts than are expressly recited in each claim. Rather, as the following claims reflect, inventive aspects lie in less than all inserts of a single foregoing disclosed aspect, embodiment, and/or configuration.

Moreover, though the Description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A wakesurf binding system comprising:

a first pair of female threaded inserts, a second pair of female threaded inserts, and a board longitudinal axis;

the first pair of female threaded inserts aligned along a first axis, wherein the first axis is angularly offset from the board longitudinal axis by a first offset angle;

the second pair of female threaded inserts aligned along a second axis, wherein the second axis is angularly offset from the board longitudinal axis by a second offset angle;

a first strap having a longitudinal axis, a first end, and a second end;

the first end of the first strap comprising a first matrix of holes therethrough;

the second end of the first strap comprising a second matrix of holes therethrough;

wherein the first strap is configured to be removably interconnected with the first pair of female threaded inserts at a third offset angle from the board longitudinal axis that is different from the first offset angle;

wherein the first strap is configured to be removably interconnected with the second pair of female threaded inserts at a fourth offset angle from the board longitudinal axis that is different from the second offset angle; and wherein the first offset angle is about 20 to 40 degrees and the second offset angle is about 20 to 40 degrees.

2. The wakesurf binding system of claim 1 further comprising:

a third pair of female threaded inserts aligned along the board longitudinal axis;

a second strap having a longitudinal axis, a first end, and a second end;

the first end of the second strap comprising a first matrix of holes therethrough;

the second end of the second strap comprising a second matrix of holes therethrough;

wherein the second strap is configured to be removably interconnected with the third pair of female threaded inserts at a fifth offset angle from the board longitudinal axis.

3. The wakesurf binding system of claim 1 wherein the first matrix of holes of the first strap comprises a 3 by pattern.

4. The wakesurf binding system of claim 1 wherein the second matrix of holes of the first strap comprises a 3 by pattern.

5. The wakesurf binding system of claim 2 wherein the first matrix of holes of the second strap comprises a 3 by pattern.

6. The wakesurf binding system of claim 2 wherein the second matrix of holes of the second strap comprises a 3 by pattern.

7. The wakesurf binding system of claim 1 wherein the third offset angle is about 25 to 35 degrees and the fourth offset angle is about 25 to 35 degrees.

8. The wakesurf binding system of claim 1 wherein the third offset angle is about 20 to 40 degrees and the fourth offset angle is about 20 to 40 degrees.

9. The wakesurf binding system of claim 1 wherein the third offset angle is adjustable by about 3 to 6 degrees and the fourth offset angle is adjustable by about 3 to 6 degrees.

10. The wakesurf binding system of claim 1 wherein the third offset angle is adjustable by about 1 to 9 degrees and the fourth offset angle is adjustable by about 1 to 9 degrees.

11. The wakesurf binding system of claim 2 wherein the fifth offset is adjustable by about 3 to 6 degrees.

12. The wakesurf binding system of claim 2 wherein the fifth offset is adjustable by about 1 to 9 degrees.

13. The wakesurf binding system of claim 1 wherein the first matrix of holes of the first strap comprises a 2 by pattern and the second matrix of holes of the first strap comprises a 2 by pattern.

14. The wakesurf binding system of claim 2 wherein the first matrix of holes of the second strap comprises a 2 by pattern and the second matrix of holes of the second strap comprises a 2 by pattern.

15. The wakesurf binding system of claim 1 wherein the first matrix of holes of the first strap comprises a 4 by pattern and the second matrix of holes of the first strap comprises a 4 by pattern.

16. The wakesurf binding system of claim 2 wherein the first matrix of holes of the second strap comprises a 4 by pattern and the second matrix of holes of the second strap comprises a 4 by pattern.

17. A wakesurf binding system comprising:

a wakesurf board comprising a top surface and a longitudinal axis;

a first pair of female threaded inserts in the top surface aligned along a first axis angularly offset from the longitudinal axis of the wakesurf board by a first offset angle;

a first strap having a first end comprising a first matrix of holes therethrough and a second end comprising a second matrix of holes therethrough, wherein the first strap is configured to be removably interconnected with the first pair of female threaded inserts at an angle offset from the first axis and wherein the first matrix of holes and second matrix of holes of the first strap comprises a 3 by pattern and the first matrix of holes and second matrix of holes of the second strap comprises a 3 by pattern;

a second pair of female threaded inserts in the top surface aligned along the longitudinal axis of the wakesurf board; and a second strap having a first end comprising a first matrix of holes therethrough and a second end comprising a second matrix of holes therethrough, wherein the second strap is configured to be removably interconnected with the second pair of female threaded inserts at an angle offset from the longitudinal axis of the wakesurf board.

18. The wakesurf binding system of claim 17 wherein the first offset angle is about 20 to 40 degrees.

19. The wakesurf binding system of claim 17 wherein the first offset angle is about 25 to 35 degrees.

20. The wakesurf binding system of claim 17 wherein the first matrix of holes and second matrix of holes of the second strap comprises a 3 by pattern.

* * * * *